US009579774B2

(12) United States Patent
Egger

(10) Patent No.: US 9,579,774 B2
(45) Date of Patent: Feb. 28, 2017

(54) GRINDING TOOL AND METHOD FOR PRODUCING SAME

(71) Applicant: Tyrolit-Schleifmittelwerke Swarovski K.G., Schwaz (AT)

(72) Inventor: Franz Egger, Vomp (AT)

(73) Assignee: TYROLIT—SCHLEIFMITTELWERKE SWAROVSKI K.G., Wattens (AT)

( * ) Notice: Subject to any disclaimer, the term of this patent is extended or adjusted under 35 U.S.C. 154(b) by 209 days.

(21) Appl. No.: 14/288,785

(22) Filed: May 28, 2014

(65) Prior Publication Data

US 2014/0273778 A1 Sep. 18, 2014

Related U.S. Application Data

(63) Continuation of application No. PCT/AT2012/000299, filed on Nov. 28, 2012.

(51) Int. Cl.
*B24D 5/06* (2006.01)
*B24D 3/06* (2006.01)
(Continued)

(52) U.S. Cl.
CPC ..... *B24D 5/06* (2013.01); *B24D 3/06* (2013.01); *B24D 3/342* (2013.01); *B24D 3/346* (2013.01);
(Continued)

(58) Field of Classification Search
CPC . B24D 3/06; B24D 3/34; B24D 3/342; B24D 3/346; B24D 5/04; B24D 5/06; B24D 5/08; B24D 5/12; B24D 5/13; B24D 7/04; B24D 7/06; B24D 7/08; B24D 18/0027; B28D 1/121
See application file for complete search history.

(56) References Cited

U.S. PATENT DOCUMENTS 5,632,941 A * 5/1997 Mehrotra ..... B24D 3/06 264/120
5,846,269 A * 12/1998 Shiue ..... B23K 35/302 51/295
(Continued)

FOREIGN PATENT DOCUMENTS

AT 506 578 10/2009
DE 100 49 605 5/2001
(Continued)

OTHER PUBLICATIONS

International Search Report issued Apr. 18, 2013 in International (PCT) Application No. PCT/AT2012/000299.
(Continued)

*Primary Examiner* — Timothy V Eley
(74) *Attorney, Agent, or Firm* — Wenderoth, Lind & Ponack, L.L.P.

(57) ABSTRACT

A grinding tool, such as a cutting disc, includes a matrix, in particular a sintered metal matrix, and diamonds embedded in the matrix. At least the majority of the diamonds are each assigned at least one wear-promoting particle and/or at least one wear-inhibiting particle. The at least one wear-promoting particle and the at least one wear-inhibiting particle are likewise embedded in the matrix.

10 Claims, 8 Drawing Sheets

(51) Int. Cl.

| | |
|---|---|
| ***B24D 3/34*** | (2006.01) |
| ***B24D 5/12*** | (2006.01) |
| ***B24D 18/00*** | (2006.01) |
| ***B28D 1/12*** | (2006.01) |

(52) U.S. Cl.

CPC ..... *B24D 5/12* (2013.01); *B24D 5/123* (2013.01); *B24D 18/0009* (2013.01); *B24D 18/0054* (2013.01); *B28D 1/121* (2013.01)

(56) References Cited

U.S. PATENT DOCUMENTS

| | | | | |
|---|---|---|---|---|
| 6,039,641 | A | 3/2000 | Sung | |
| 6,193,770 | B1 | 2/2001 | Sung | |
| 6,435,958 | B1 | 8/2002 | Damgaard et al. | |
| 6,615,816 | B2 * | 9/2003 | Ogata | B24D 3/34 125/15 |
| 7,337,775 | B2 * | 3/2008 | Kim | B23D 61/18 125/13.01 |
| 8,028,687 | B2 * | 10/2011 | Kim | B23D 61/18 125/22 |
| 8,628,385 | B2 * | 1/2014 | Wu | B24D 3/346 451/28 |
| 9,259,855 | B2 * | 2/2016 | Um | B23D 61/04 |
| 2003/0089364 | A1 | 5/2003 | Kim et al. | |
| 2005/0103534 | A1 | 5/2005 | Kim et al. | |

FOREIGN PATENT DOCUMENTS

| | | |
|---|---|---|
| EP | 1 297 928 | 4/2003 |
| FR | 2149833 | 3/1973 |
| GB | 1 374 513 | 11/1974 |
| WO | 03/066275 | 8/2003 |
| WO | 2010/031089 | 3/2010 |

OTHER PUBLICATIONS

Austrian Search Report issued Sep. 24, 2012 in Austrian Patent Application No. A 1778/2011 with English translation.

* cited by examiner

GRINDING TOOL AND METHOD FOR PRODUCING SAME

BACKGROUND OF THE INVENTION

1. Field of the Invention

The invention concerns a grinding tool, in particular a cutting disc, comprising a matrix, in particular a sintered metal matrix, and diamonds embedded in the matrix. In addition, the invention seeks to provide a process for producing the grinding tool according to the invention.

2. Description of Related Art

Such grinding tools belong to the state of the art and are described, for example, in AT 506 578 B1. The grinding action of those tools is based on the fact that the diamonds project a bit from the matrix and are in contact with the article to be ground.

The grinding action can be substantially detrimentally impaired by two effects: on the one hand, the diamonds can prematurely break out of the matrix. On the other hand, the effect has been observed that the regions—viewed in the grinding direction—upstream of the diamonds become "clogged" during the grinding process and as a result, the capability of engagement on the part of the diamonds is lost.

SUMMARY OF THE INVENTION

The object of the present invention is to avoid those disadvantages and to provide a grinding tool of the kind set forth in the opening part of this specification, that is improved over the state of the art, as well as a process for the production thereof, wherein the grinding tool according to the invention is distinguished in particular by an improved grinding action and an increased service life.

According to the invention, that object is attained by features described herein.

According to the invention therefore it is provided that, associated with each of at least a majority of the diamonds, is at least one wear-promoting particle and/or at least one wear-inhibiting particle, wherein the at least one wear-promoting particle and the at least one wear-inhibiting particle are also embedded in the matrix. In addition, it is provided that the grinding tool has a preferred grinding direction, and that the at least one wear-promoting particle is embedded in the matrix upstream of the diamond with which it is associated in the grinding direction, and that the at least one wear-inhibiting particle is embedded in the matrix downstream of the diamond with which it is associated in the grinding direction. More specifically, the at least one wear-promoting particle then provides that the region of the binding of the diamond in the matrix—viewed in the grinding direction of the grinding tool—upstream of the diamond is sufficiently worn and thus the capability of engagement of the diamond is retained. Conversely, the at least one wear-inhibiting particle provides that the wear of the downstream region—viewed in the grinding direction of the grinding tool—of the binding of the diamond in the matrix is reduced and thereby the diamond is prevented from prematurely breaking out of the matrix.

The described action of the at least one wear-promoting particle and the at least one wear-inhibiting particle, respectively, can in addition also be increased if the at least one wear-promoting particle is at a smaller spacing relative to the grinding contact surface of the grinding tool in relation to the diamond with which it is associated and the at least one wear-inhibiting particle is at a greater spacing relative to the grinding contact surface in relation to the diamond with which it is associated. In that way, in the abrasion of the grinding tool which takes place during the grinding process, firstly the at least one wear-promoting particle comes into contact with the article to be ground, and as a result breaks out and frees the diamond which is arranged somewhat beneath. If a wear-inhibiting particle which is arranged somewhat beneath the diamond is additionally also associated with that diamond, then that wear-inhibiting particle provides for stabilization of the binding of the diamond in the matrix.

In a preferred embodiment, it can be provided that the at least one wear-promoting particle comprises at least partially and preferably entirely pre-sintered granular material, preferably a binding phase and incorporated molybdenum disulfide and/or graphite powder. In that case, the binding phase can at least partially and preferably entirely comprise copper, cobalt, iron, bronze or nickel. In alternative embodiments, the at least one wear-promoting particle at least partially and preferably entirely comprises glass balls, mineral granular materials (ceramics or broken ceramic) or broken mineral (for example, steatite, limestone, chamotte, silicates, carbonates, nitrides and sulfides).

The at least one wear-inhibiting particle at least partially and preferably entirely comprises hard metal grit, corundum, silicon carbide and/or boronitride.

In addition, it has proven to be advantageous if the at least one wear-promoting particle and/or the at least one wear-inhibiting particle is of a grain size of between 250 μm and 600 μm. It is thus somewhat smaller than the grain size of between 350 μm and 700 μm which is preferably used with respect to the diamonds.

It is further proposed that the grinding tool includes at least one grinding segment, wherein the at least one grinding segment is arranged on at least one carrier body, preferably of steel. In that case, the at least one grinding segment can be, for example, welded or soldered to the at least one carrier body.

A process for producing the grinding tool according to the invention is also provided, wherein:

- in a first process step, a matrix layer is formed from a sinterable material in powder form,
- in a second process step, diamonds are placed on the matrix layer in a predetermined placement pattern,
- in a third process step, at least one wear-promoting particle and/or at least one wear-inhibiting particle is placed on the matrix layer at a predetermined spacing relative to each of at least the majority of the diamonds,
- in a fourth process step, the matrix layer provided with the diamonds and the at least one wear-promoting particle and the at least one wear-inhibiting particle, respectively, are pressed, and
- in a concluding process step, a sintering process is carried out.

In an advantageous embodiment of the process prior to the concluding process step, further matrix layers are successively applied and the second, third and fourth process steps are respectively repeated until a predetermined width is reached.

In addition it can be provided that, prior to the second process step, recesses are formed in the matrix layer to receive the diamonds and/or the at least one wear-promoting particle and the at least one wear-inhibiting particle, respectively.

Finally, in regard to short process times, it has proven to be advantageous if at least the second and third process steps are carried out simultaneously.

BRIEF DESCRIPTION OF THE DRAWINGS

Further details and advantages of the present invention are described more fully hereinafter by means of the specific description with reference to the embodiments illustrated in the drawings in which.

DETAILED DESCRIPTION OF THE INVENTION

Figure 1:
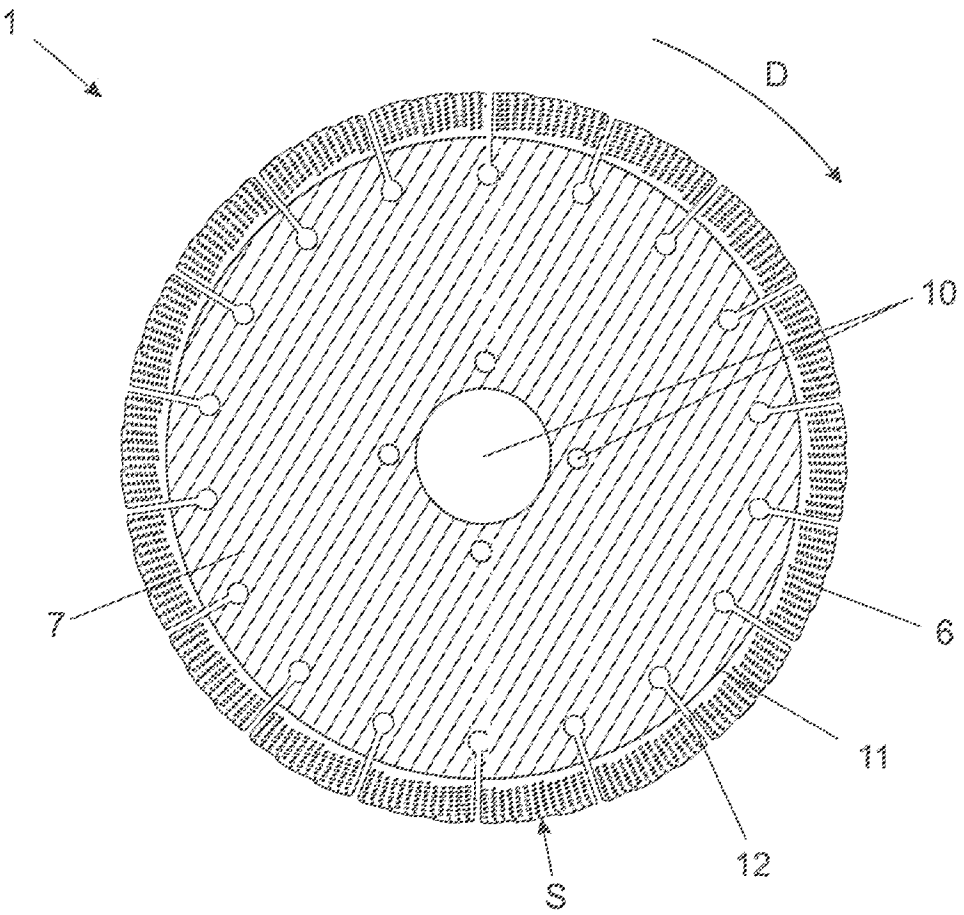
FIG. 1 shows a diagrammatically illustrated plan view of a preferred embodiment of the grinding tool according to the invention in the form of a cutting disc.

FIG. 1 shows a preferred embodiment of a grinding tool 1 according to the invention in the form of a cutting disc. This involves generally a circular flat disc which mostly serves as a component part of an angle or cutting grinder for workpiece machining. In addition, cutting discs are also used in wall and joint cutting machines. A distinction is drawn between various kinds of cutting discs, the illustrated case involving a so-called diamond cutting disc which is used, in particular, for working with natural stone, concrete or asphalt. More specifically, the cutting disc 1 comprises a carrier body 7 in the form of a steel disc (cutting disc blade), at the outer periphery of which are arranged a series of grinding segments 6. The grinding segments 6 are welded to the outer edge 11 of the carrier body 7. The carrier body 7 further has mounting or fixing bores 10 for fitting the cutting disc 1 into an angle or cutting grinder or into a wall or joint cutting machine. The individual grinding segments 6 are separated from each other by slots 12. In the condition of use, the cutting disc 1 is caused to rotate, the cutting disc 1 having a preferred grinding direction D. Cutting discs are generally used for cutting off pieces of material and therefore have a very narrow grinding contact surface S which extends over the front side of the cutting disc 1.

Figure 2A:
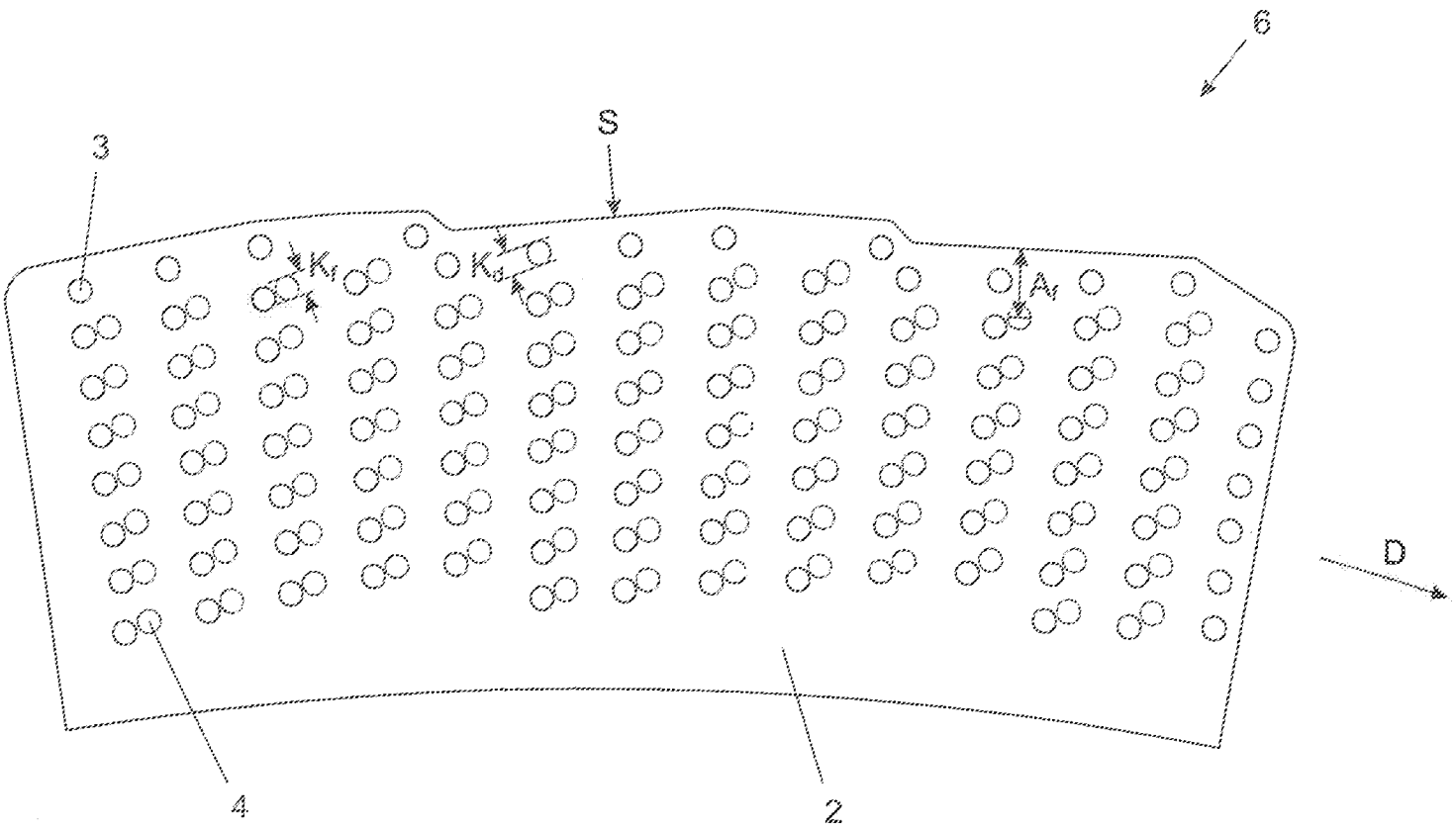
FIG. 2*a* shows a diagrammatically illustrated plan view of a first preferred embodiment of a grinding segment.

FIG. 2*a* shows a view on an enlarged scale of one of the grinding segments 6 in a first preferred embodiment. A basic component of the grinding segment 6 is a sintered metal matrix 2 in which diamonds 3 are embedded. The diamonds 3 are of a grain size $K_d$ of between 350 μm and 700 μm. The spacing of the center points of the diamonds 3 is between 1 and 2 mm. In this first preferred embodiment of the grinding segment 6, a wear-promoting particle 4 is associated with each of the majority of the diamonds 3, wherein the wear-promoting particles 4—as viewed in the grinding direction D—are respectively embedded into the matrix 2 upstream of the diamonds 3 with which they are associated. In addition, in relation to the diamonds 3 with which they are associated, they are at a smaller spacing $A_f$ in relation to the grinding contact surface S. The grain size $K_f$ of the wear-promoting particles 4 is between 250 μm and 600 μm. It should also be pointed out that no wear-promoting particle 4 is associated with an individual diamond 3, in particular, in the edge region of the grinding segment 6. The spacing of the center point of the diamonds 3 relative to the center point of the wear-promoting particles 4 respectively associated therewith approximately corresponds to the grain size $K_f$ of the wear-promoting particles 4.

Figure 2B:
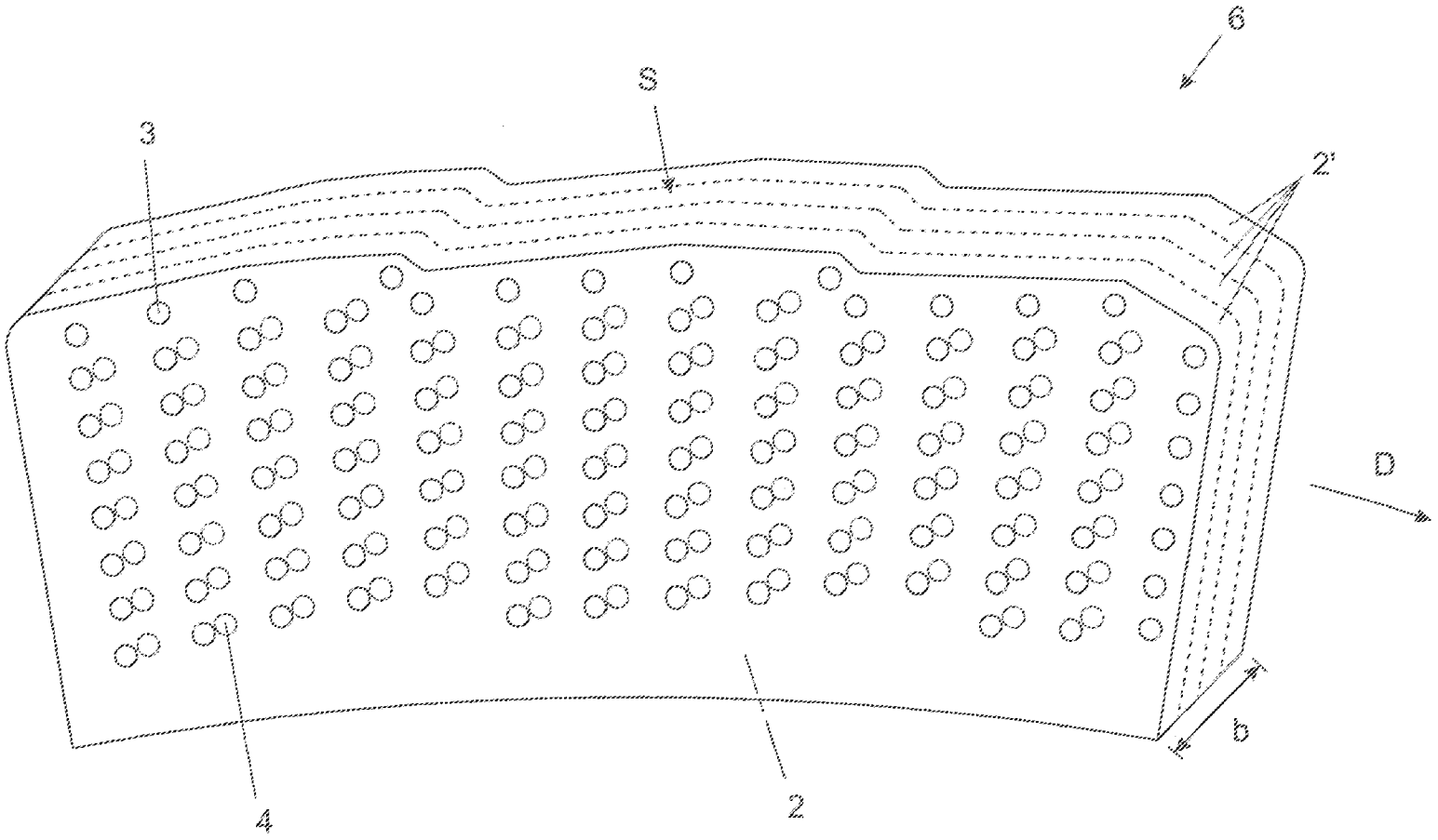
FIG. 2*b* shows a diagrammatically illustrated perspective view of the first preferred embodiment of the grinding segment of FIG. 2*a*.

FIG. 2*b* diagrammatically shows a perspective view of the grinding segment 6 from FIG. 2*a*. It can be seen that, in this case, the grinding segment 6 comprises four layers 2' which are arranged in mutually superposed relationship and are made up approximately like the upper layer that faces towards the viewer. The layer structure is indicated by the three dotted separating lines. The width of the grinding segment 6 is denoted by reference b.

Figure 3:
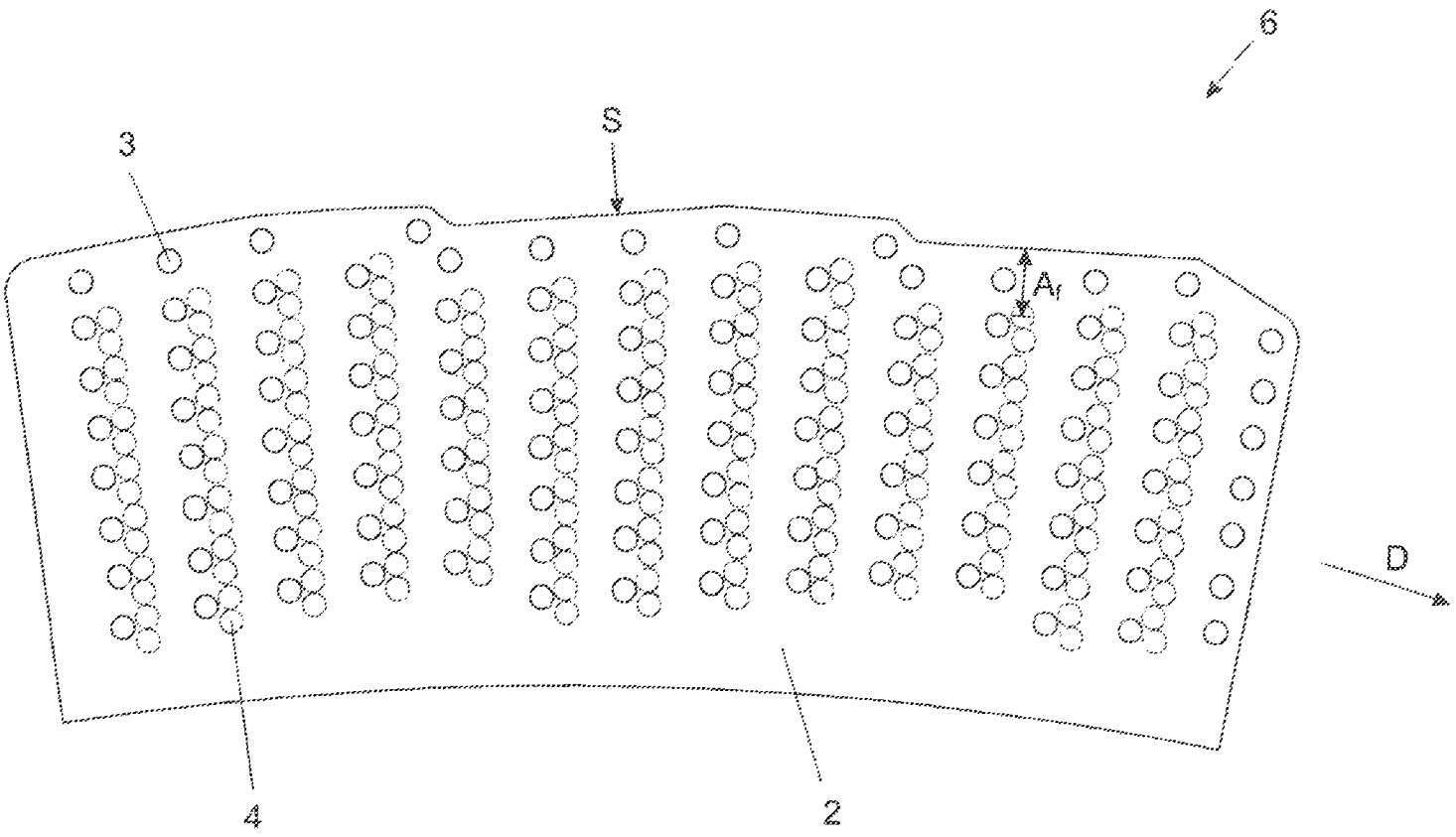
FIG. 3 shows a diagrammatically illustrated plan view of a second preferred embodiment of a grinding segment.
Figure 4:
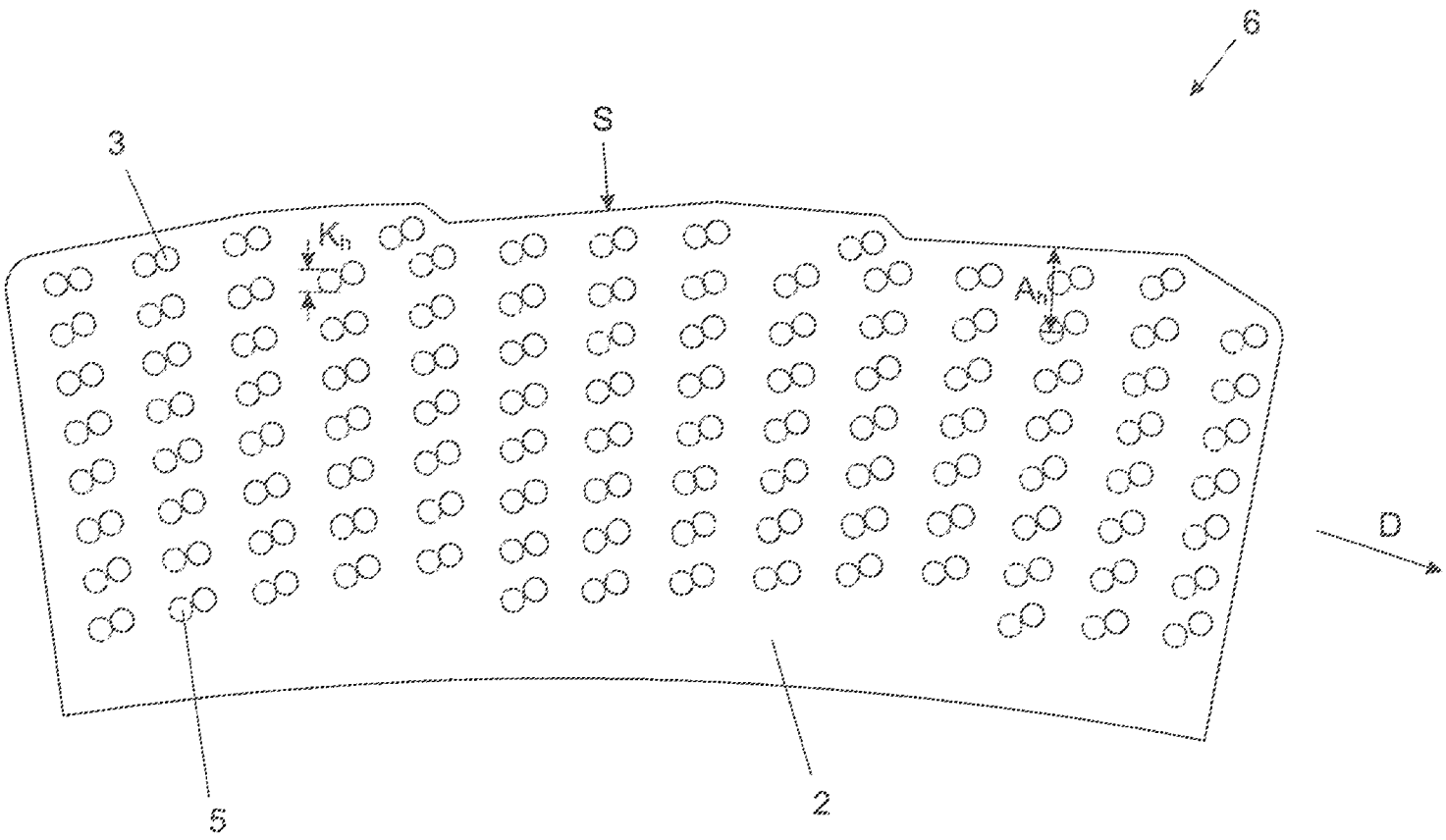
FIG. 4 shows a diagrammatically illustrated plan view of a third preferred embodiment of a grinding segment.
Figure 5:
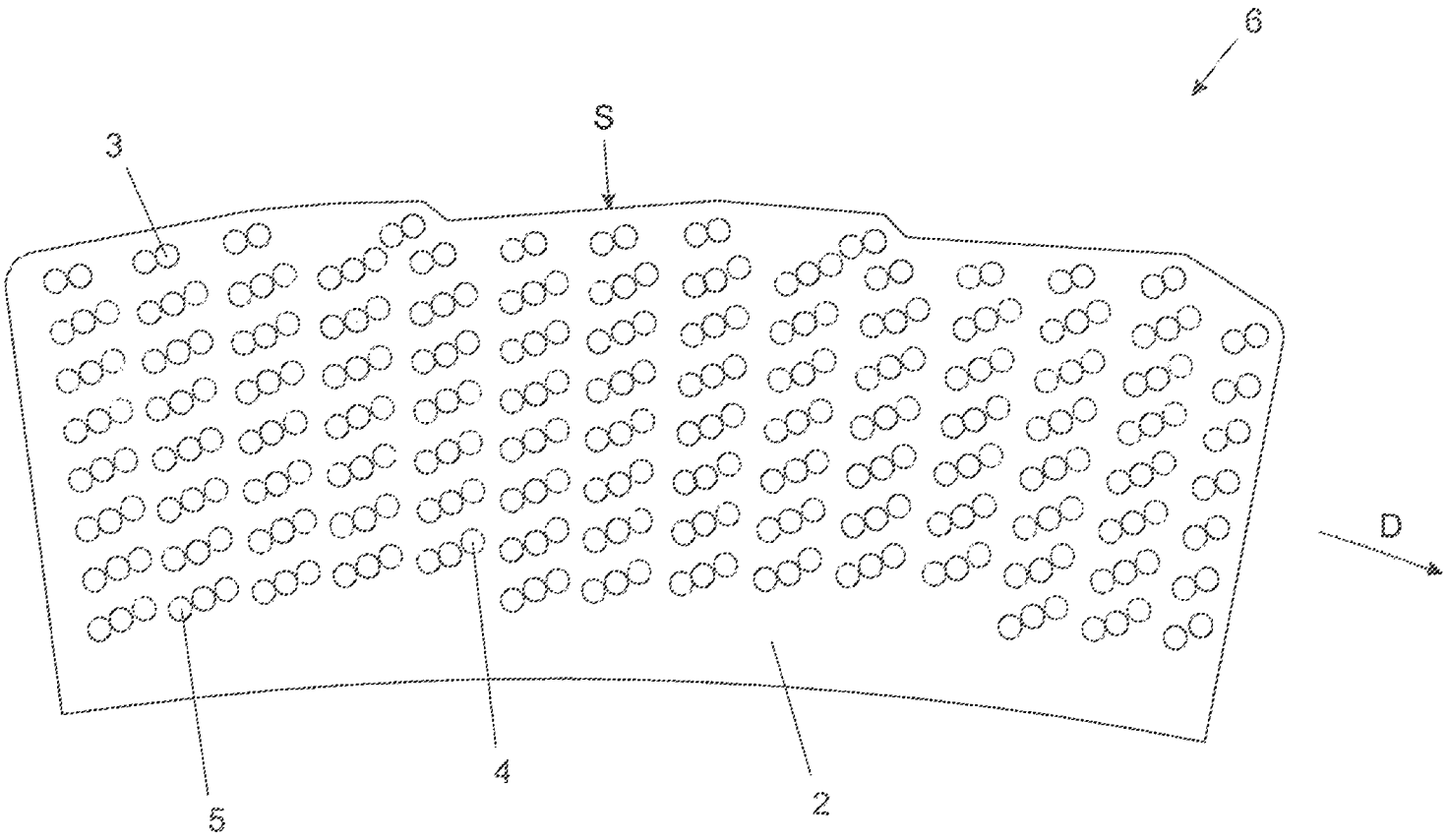
FIG. 5 shows a diagrammatically illustrated plan view of a fourth preferred embodiment of a grinding segment.

Three further preferred embodiments of the grinding segment 6 are shown in FIGS. 3, 4 and 5. Unlike the first embodiment shown in FIGS. 2*a* and 2*b*, the embodiment to be seen in FIG. 3 is characterized in that two wear-promoting particles 4 are associated with each of the majority of the diamonds 3. In that way, the wear-promoting action of those particles 4 (see the introductory part of this description) is still further enhanced. It should also be pointed out that, in this embodiment, both wear-promoting particles 4 are respectively embedded in the matrix 2 upstream of the diamond with which they are associated—viewed in the grinding direction D of the grinding tool—and one of the two particles 4 is at a smaller spacing $A_f$ relative to the grinding contact surface S in relation to the diamond 3 and the other of the two particles 4 is at a greater spacing $A_f$ relative to the grinding contact surface S.

The embodiment shown in FIG. 4 is characterized in that a wear-inhibiting particle 5 is associated with each of the diamonds 3, wherein those wear-inhibiting particles 5—viewed in the grinding direction D—are respectively embedded in the matrix 2 downstream of the diamonds 3 with which they are associated. In addition, in relation to the diamonds with which they are associated, they are of a greater spacing $A_h$ with respect to the grinding contact surface S. The grain size $K_h$ of the wear-inhibiting particles 5 is again between 250 μm and 600 μm.

The fourth embodiment of the grinding segment 6 to be seen in FIG. 5 is finally characterized in that at least one wear-promoting particle 4 and wear-inhibiting particle 5 are associated with each of the majority of the diamonds 3, wherein the wear-promoting particle 4 is embedded in the matrix 2 upstream of the diamond 3 with which it is associated, as viewed in the grinding direction D, and the wear-inhibiting particle 5 is embedded in the matrix 2 downstream of the diamond 3 with which it is associated, as viewed in the grinding direction D.

Figure 6:
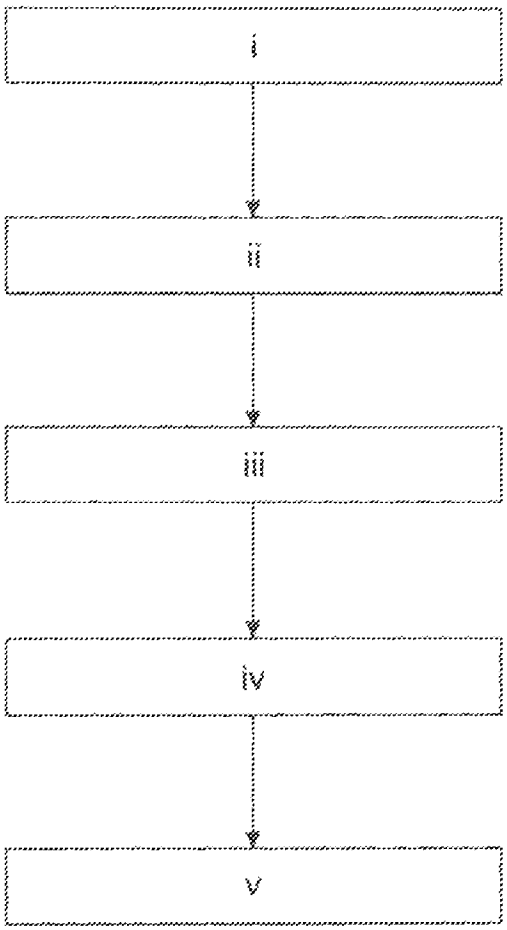
FIG. 6 shows a diagrammatically illustrated flowchart to illustrate a preferred embodiment of the process for producing a grinding tool according to the invention.

FIG. 6 is a diagrammatic flowchart illustrating the five essential process steps for production of the grinding tool according to the invention. In a first process step (i), a matrix layer is formed from a sinterable material in powder form. In a second process step (ii), diamonds are placed on the matrix layer in a predetermined placement pattern. In a third process step (iii)—depending on the embodiment involved—at least one wear-promoting particle and/or at least one wear-inhibiting particle is placed on the matrix layer at a predetermined spacing relative to each of at least the majority of the diamonds. In a fourth process step (iv), the matrix layer provided with the diamonds and the at least one wear-promoting particle or the at least one wear-inhibiting particle is pressed and finally sintered in a concluding process step (v).

In the preferred embodiment of this process, moreover, further matrix layers are successively applied prior to the concluding process step (v) and the second, third and fourth process steps (ii), (iii) and (iv) are respectively repeated until a predetermined width b is reached (see also FIG. 2*b*). Also in the preferred embodiment of the process, recesses are formed in the matrix layer prior to the second process step (ii)_for receiving the diamonds and the at least one wear-promoting particle or the at least one wear-inhibiting particle.

In regard to the first process step (i), it is to be noted that the matrix layer is formed by the sinterable material in powder form firstly being introduced by shaking into a segment mold by way of a portioning device. After the introduction operation, the surface is scraped off to give a flat surface. The metal powder layer is then subjected to light pressure. In the course of that pressing operation, the recesses for receiving the diamonds and the at least one wear-promoting particle or the at least one wear-inhibiting particle are also already formed at the same time in the matrix layer, those recesses being, for example, in the shape of truncated cones or truncated pyramids.

In regard to the second and third process steps (ii) and (iii), it is to be noted that the diamonds and the wear-promoting particles or the wear-inhibiting particles are lightly pressed into the metal powder upon being placed on the matrix layer.

In regard to the time sequence of the described process steps, it is noted that—depending on the kind and number of the placement devices used—the second and third process steps (ii) and (iii) are also carried out at the same time. Basically, in connection with the invention, preferably either two different placement devices are used, one for the diamonds and the other for the wear-promoting or wear-inhibiting particles, or only a single placement device is used, which places both the diamonds and also the wear-promoting and/or wear-inhibiting particles on the matrix layer. In the latter case, placement of the diamonds and the wear-promoting and/or wear-inhibiting particles is carried out in succession or simultaneously.

Figure 7B:
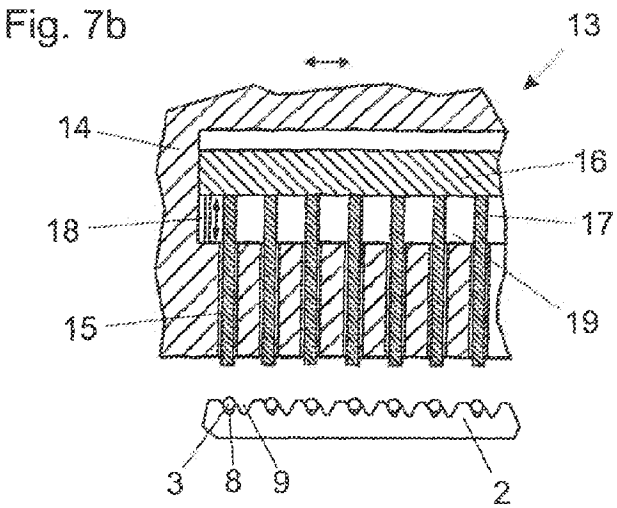
FIGS. 7*a*-7*d* show a diagrammatically illustrated succession of two process steps in which firstly the diamonds and then wear-promoting particles are placed on a matrix layer.
Figure 7D:
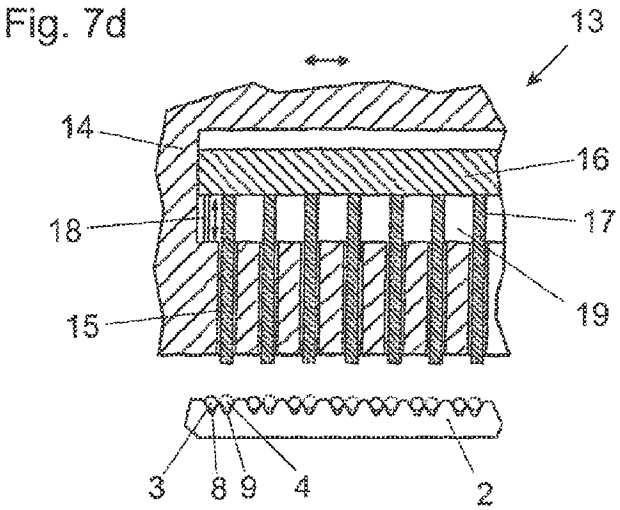
Figure 7A:
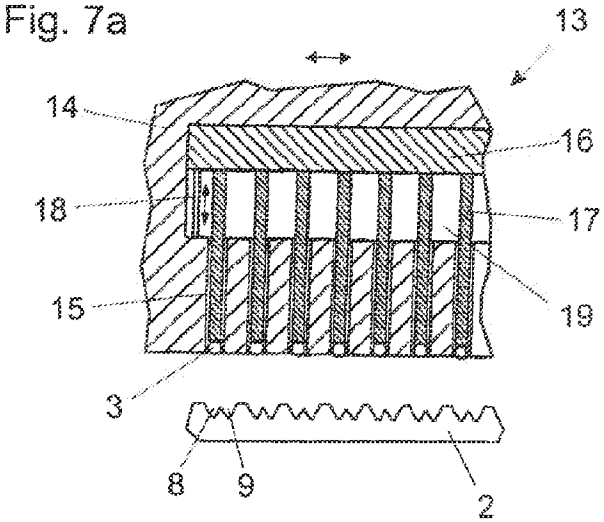
Figure 7C:
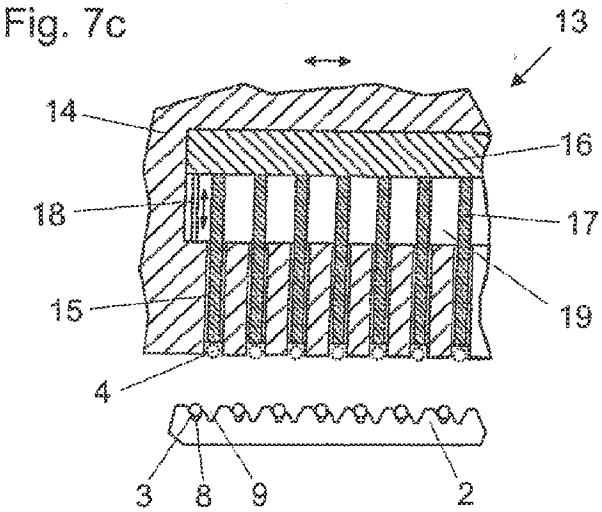

In the case shown in FIGS. 7*a* through 7*b*, the process is carried out by means of a common placement device 13, wherein the diamonds 3 and—in the illustrated case—the wear-promoting particles 4 are successively placed on the matrix layer 2. FIGS. 7*a* through 7*d* diagrammatically show an implementation by way of example of the second and third process steps. The preceding first process step is not shown, in which the metal matrix layer 2 is formed and then recesses 8 and 9 are produced for receiving the diamonds 3 or the wear-promoting particles 4 associated therewith.

The illustrated placement device 13 is substantially an aperture plate 14 provided with bores 15, wherein passing through the bores 15 are pins 17 which are connected to a ram plate 16. A reduced pressure is generated in the internal space 19 of the aperture plate 14 and is propagated to the mouth openings of the bores 15 so that a diamond 3, a wear-promoting particle 4 or a wear-inhibiting particle 5 (not shown) can be held fast there. To place the suction-held diamonds 3, the wear-promoting particles 4 or the wear-inhibiting particles 5 on the preformed metal powder layer 2, the aperture plate 14 is moved so close to the metal powder layer 2 that there is not yet any suction attraction of powder. If the diamonds 3, the wear-promoting particles 4 or the wear-inhibiting particles 5 were now simply to be allowed to drop from the height set in that way, that would not result in a regular arrangement of the diamonds 3, the wear-promoting particles 4 or the wear-inhibiting particles 5. Therefore, the diamonds 3, the wear-promoting particles 4 or the wear-inhibiting particles 5 are ejected by displacement of the ram plate 14 in a suitable guide 18 by means of the pins 17. In the case of the illustrated placement device 13, the diamonds 3, the wear-promoting particles 4 or the wear-inhibiting particles 5 are therefore not pressed into the metal powder—in the way that this can also be provided (see above).

Following placement of the diamonds 3 (FIGS. 7*a* and 7*b*) and placement of the particles, which in the illustrated case are the wear-promoting particles 4, beside the majority of the diamonds 3 (FIGS. 7*c* and 7*d*), the metal powder layer 2 provided with the diamonds 3 and the wear-promoting particles 4 is pressed, if necessary, a further metal powder layer 2 is applied and the second, third and fourth process steps are repeated and finally the grinding segment is finished in a sintering process.

The invention claimed is:

1. A grinding tool, comprising a matrix, and diamonds embedded in the matrix, wherein:

each of at least a majority of the diamonds has at least one wear-promoting particle and at least one wear-inhibiting particle associated therewith, the at least one wear-promoting particle and the at least one wear-inhibiting particle are embedded in the matrix, the grinding tool has a grinding direction, the at least one wear-promoting particle is embedded in the matrix upstream of the diamond with which the at least one wear-promoting particle is associated in the grinding direction and the at least one wear-inhibiting particle is embedded in the matrix downstream of the diamond with which the at least one wear-inhibiting particle is associated in the grinding direction, and the grinding tool has a grinding contact surface which is towards an article to be ground in a condition of use, the at least one wear-promoting particle is at a smaller spacing relative to the grinding contact surface in relation to the diamond with which the at least one wear-promoting particle is associated, and the at least one wear-inhibiting particle is at a greater spacing relative to the grinding contact surface in relation to the diamond with which the at least one wear-inhibiting particle is associated.

2. The grinding tool as set forth in claim 1, wherein the grinding tool is a cutting disc.

3. The grinding tool as set forth in claim 1, wherein the matrix is a sintered metal matrix.

4. The grinding tool as set forth in claim 1, wherein the at least one wear-promoting particle comprises pre-sintered granular material.

5. The grinding tool as set forth in claim 4, wherein the pre-sintered granular material comprises a binding phase and incorporated molybdenum disulfide and/or graphite powder.

6. The grinding tool as set forth in claim 5, wherein the binding phase comprises copper, cobalt, iron, bronze or nickel.

7. The grinding tool as set forth in claim 1, wherein the at least one wear-inhibiting particle comprises hard metal grit, corundum, silicon carbide and/or boronitride.

8. The grinding tool as set forth in claim 1, wherein the at least one wear-promoting particle and/or the at least one wear-inhibiting particle is of a grain size of between 250 μm and 600 μm.

9. The grinding tool as set forth in claim 1, further comprising at least one grinding segment, wherein the at least one grinding segment is arranged on at least one carrier body.

10. The grinding tool as set forth in claim 9, wherein the at least one carrier body comprises steel.

* * * * *